US005249757A

United States Patent [19]

Draghetti et al.

[11] Patent Number: 5,249,757

[45] Date of Patent: Oct. 5, 1993

[54] METHOD AND DEVICE FOR CHANGING ROLLS IN A MACHINE UTILIZING STRIP MATERIAL

[75] Inventors: Fiorenzo Draghetti, Medicina; Silvano Boriani; Igino Conti, both of Bologna, all of Italy

[73] Assignee: G.D. S.p.A., Bologna, Italy

[21] Appl. No.: 808,900

[22] Filed: Dec. 18, 1991

[30] Foreign Application Priority Data

Dec. 24, 1990 [IT] Italy ..... 3788 A/90

[51] Int. Cl.[5] ..... B65H 19/12

[52] U.S. Cl. ..... 242/58.6

[58] Field of Search ..... 242/58-58.6; 156/157, 502, 504, 505

[56] References Cited

U.S. PATENT DOCUMENTS

| | | | |
|---|---|---|---|
| 4,441,662 | 4/1984 | Seragnoli | 242/58 |
| 4,555,070 | 11/1985 | Pali | 242/58.1 |
| 4,575,016 | 3/1986 | Pali | 242/58.2 X |
| 4,588,344 | 5/1986 | Burk et al. | 242/58.6 X |
| 4,597,316 | 7/1986 | Ichikawa | 242/58 X |
| 4,896,842 | 1/1990 | Focke et al. | 242/58.6 |
| 5,031,381 | 7/1991 | Focke | 242/58.6 X |

*Primary Examiner*—Daniel P. Stodola
*Assistant Examiner*—John P. Darling
*Attorney, Agent, or Firm*—Cushman, Darby & Cushman

[57] ABSTRACT

In a machine utilizing rolls of strip material for whatever purpose, typically a wrapping machine, the depleted rolls are replaced by new rolls taken up in succession from a magazine by a transfer unit including a gripping head that can be traversed along a guide, which in turn can be rotated about and reciprocated along the dispensing axis of the magazine. Being thus rotatable about a permanent axis, the guide can be made selectively to assume different angular positions, each coinciding with a line connecting this same axis with the axis of a respective uncoiling pivot provided by the machine.

10 Claims, 5 Drawing Sheets

METHOD AND DEVICE FOR CHANGING ROLLS IN A MACHINE UTILIZING STRIP MATERIAL

BACKGROUND of the INVENTION

The invention relates to a method of changing rolls in a machine utilizing strip material. In the context of the specification, the "machine" may be taken to mean any type of equipment designed to make use of strip material, and more especially a wrapping machine in which such strip material is utilized for the purpose of enveloping or packaging commodities (i.e., articles).

It is a standard practice, in machines of the type in question, to utilize rolls of strip material arranged in alignment one with the next along a common axis internally of a magazine. The rolls are taken up from the magazine singly and in succession by means of a transfer device and supplied thus to the wrapping machine. The prior art also embraces machines of high output capacity equipped with at least two uncoiling stations, each of which provides a respective uncoiling axis and accommodates one roll. As each roll is depleted, the other uncoiling station comes into operation.

U.S. Pat. No. 4,896,842 discloses the expedient of supplying rolls of strip material to one or other of two uncoiling stations by means of a transfer device comprising a head, capable of taking up one roll, which is carried by the end of an arm mounted pivotably about an axis positioned between the two uncoiling stations and equidistant from their axes.

Due to rocking motion of the arm, the head describes a trajectory coinciding with an arc to a circle that intersects both the axes of the two uncoiling stations and the common axis of the rolls occupying the magazine. Thus, it becomes possible to take up a roll from the magazine by means of the transfer head, and by swinging the arm, to transfer the head together with the roll from the magazine to one or other of the two uncoiling stations.

The conventional transfer device briefly outlined above has certain drawbacks of both structural and operational character, attributable in essence to the movement whereby the head is distanced from the common axis of the rolls occupying the magazine (in effect, the magazine axis) and aligned with the axis of one or other uncoiling station, which is such that the change roll must always describe an arc to a circle. Given the sometimes notable mass and diametral proportions of the rolls of strip material utilized, such a movement requires the application of relatively high driving and braking torques to the arm. Also, the need to accommodate this movement imposes a marked rigidity in general design of the machine. In effect, the machine must always be proportioned in such a way that the axis of rotation of the transfer arm can be positioned equidistant from the axes of the magazine and the uncoiling stations. Again, if one is to minimize both the dimensions of the transfer device as a whole, and the driving/-braking torque applied to the arm, then the length of the arm itself must be reduced to a bare minimum by siting its pivot axis exactly mid-way between the axes of the uncoiling stations, indeed equidistant from the two axes in question and occupying a common plane, as disclosed in U.S. Pat. No. 4,896,842.

It will be clear that the conventional transfer device aforementioned not only requires somewhat high powered rotary actuators in order to operate correctly, but is unsuitable in general terms for integration into existing machines given that the geometry of such machines will not correspond in most instances to that expressly required by the device.

SUMMARY OF THE INVENTION

The object of the present invention, accordingly, is to provide a method, free of the limitations described above, by which to take up rolls of strip material from a magazine and transfer them to a plurality of uncoiling stations provided by a main machine.

More especially, the object of the invention is to provide a method of picking up and transferring rolls in general, and in particular of effecting the entire roll change operation in a wrapping machine or similar equipment designed to make use of such strip material, which will enable the use of relatively low power acturators and is suitable for intergation into a wide range of production machines currently in service.

The stated object is fully realized in a method applicable to any given machine of a type designed to utilize rolls of strip material, which provides a first axis along and coaxially with which to align a plurality of rolls, and at least two second axes from which single rolls are uncoiled. The method disclosed comprises the step of transferring rolls singly from the first axis to one of the second axes, and provides the advantage that the transfer movement occurs along a rectilinear trajectory, guided by means able to assume different positions by rotating about the first axis.

The method disclosed is implemented by means of a device likewise constituting subject matter of the invention. Such a device is therefore applicable to machines providing first axis along and coaxially with which to align a plurality of rolls, and at least two second axes from which single rolls are uncoiled, and comprises means by which to transfer the single rolls in succession from the first axis to either one of the two second axes. Preferably, the transfer means comprise rectilinear guide means permanently intersecting the first axis, slide means associated with the guide means, means by which roll-gripping to grip the single roll, which are carried by and traversed as one with the slide means along the guide means, also first actuator means by which the guide means can be rotated about the first axis and made selectively to intersect one or other of the two second axes, and actuator means by which the gripping means are traversed along the guide means through a distance equal to that which separates the first axis and the intersected second axis.

BRIEF DESCRIPTION of the DRAWINGS

The invention will now be described in detail, by way of example, with the aid of the accompanying drawings, in which.

DESCRIPTION of the PREFERRED EMBODIMENTS

Figure 1:
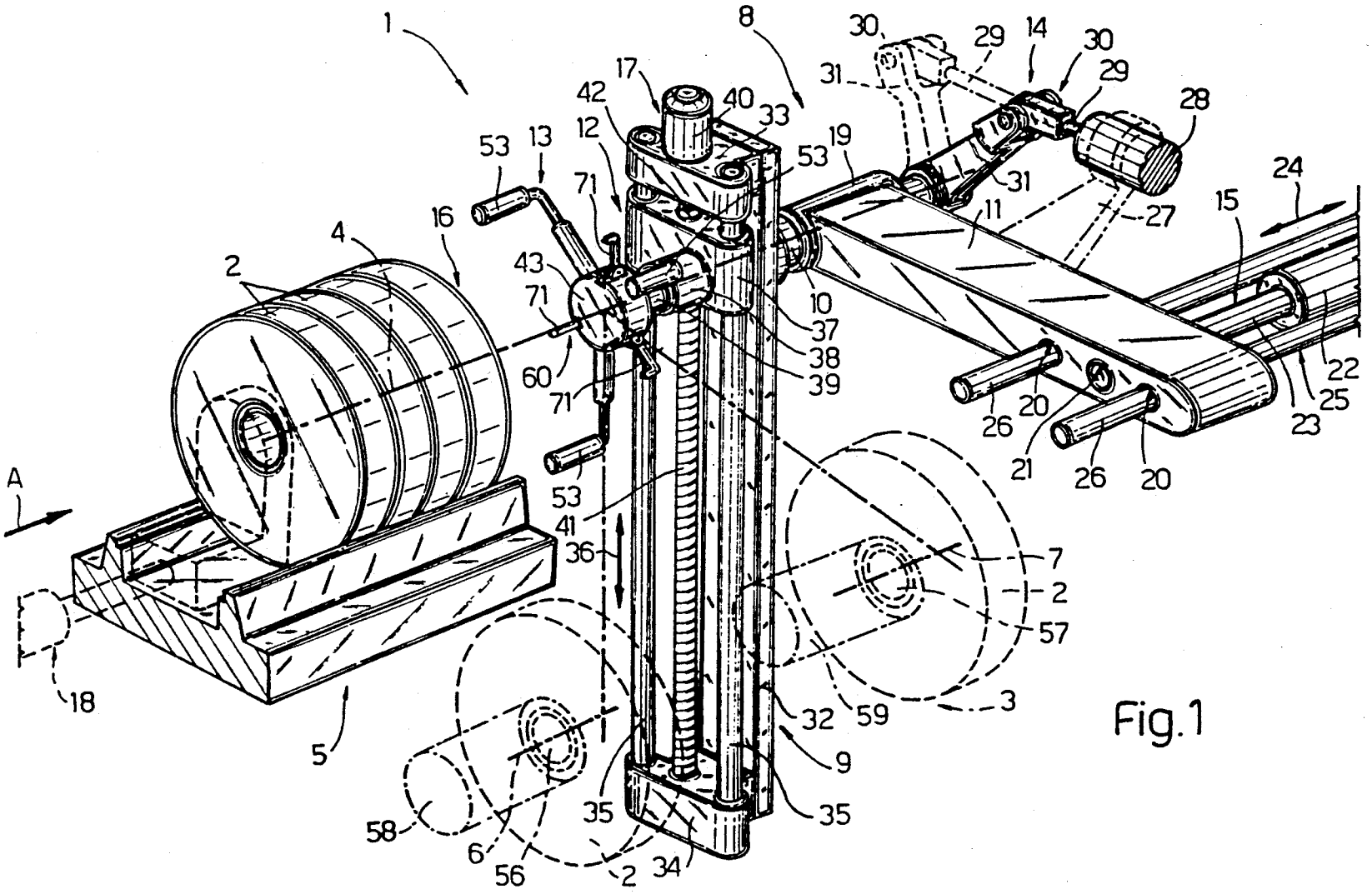
FIG. 1 is an axonometric projection of the roll change device according to the present invention, seen in a preferred embodiment.

Referring to FIG. 1 of the drawings, 1 denotes a device, in its entirety, by which rolls 2 of strip material are changed in, say, a wrapping machine 3. The machine 3 provides a first axis 4 along which to align a plurality of rolls 2, disposed coaxially with the axis 4 and capable of axial movement along a magazine 5 forming part of the device 1, and two second axes 6 and 7 disposed parallel to the first axis 4, from which the rolls 2 are uncoiled.

In addition to the magazine 5, the change device 1 comprises a unit 8 by means of which the rolls 2 can be transferred singly and succession from a position within the magazine 5, coinciding with the first axis 4, to a position coinciding with either one of the second axes 6 and 7. The transfer unit 8 comprises a rectilinear guide 9 intersecting the first axis 4 and associated rigidly with one end of a shaft 10 that is aligned coaxially with the first axis 4 and carried rotatably by a support 11. The unit 8 further comprises a slide 12, associated with the guide 9 and able to traverse thereon in a direction normal to the first axis 4, and a device denoted 13 capable of gripping the single rolls 2, which is carried by the slide 12 and can thus be moved as one therewith along the guide 9.

The same unit 8 also comprises: a first actuator device 14 interposed between the support 11 and the shaft 10, by means of which the shaft 10 and the guide 9 can be rotated together about the first axis 4 and the guide 9 thus made, selectively, to intersect either one of the two second axes 6 or 7; a second actuator device 15 by which the support 11 together with the shaft 10, guide 9, slide 12 and gripping device 13 can be shifted parallel with the first axis 4 toward and away from a station 16 at which rolls 2 are taken up from the magazine 5 by the gripping device 13; a third actuator device 17 by means of which to traverse the slide 12 and the gripping device 13 along the guide 9 between the first axis 4 and one or other of the second axes 6 and 7; and a fourth actuator device 18 associated with the magazine 5 by which the supply of rolls 2 is pushed along the first axis 4 toward the take-up station 16.

As discernible from FIG. 1, the support 11 is of elongated embodiment and disposed with longitudinal axis (not indicated) normal to the first axis 4. One end of the support 11 provides a bushing 19, coaxially aligned with the first axis 4, by which the shaft 10 is accommodated rotatably and without freedom of relative axial movement. The end of the support 11 farthest from the bushing 19 provides a pair of holes 20, and a further hole 21 disposed between and parallel with the paired holes 20 and parallel also to the first axis 4.

The second actuator device 15 comprises a linear actuator 22 of which the exposed rod 23 is inserted forcibly into the hole denoted 21. Reciprocation of the rod 23 causes the support 11 to move back and forth in the direction denoted 24, parallel to the first axis 4, along a guide 25 disposed parallel likewise with the first axis 4 and comprising two rods 26 inserted slidably through the holes 20.

Figure 2:
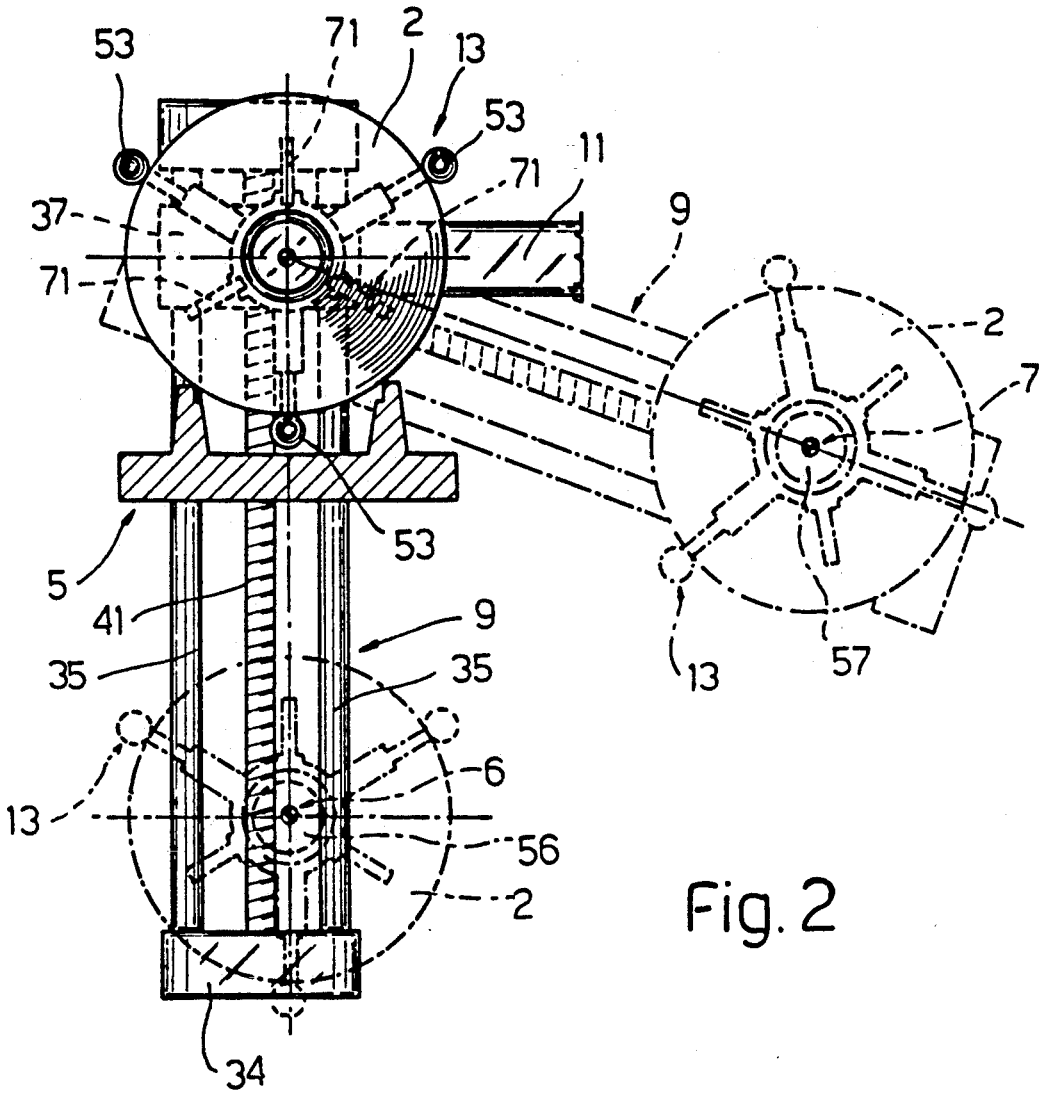
FIG. 2 is the view from A in FIG. 1.
Figure 3:
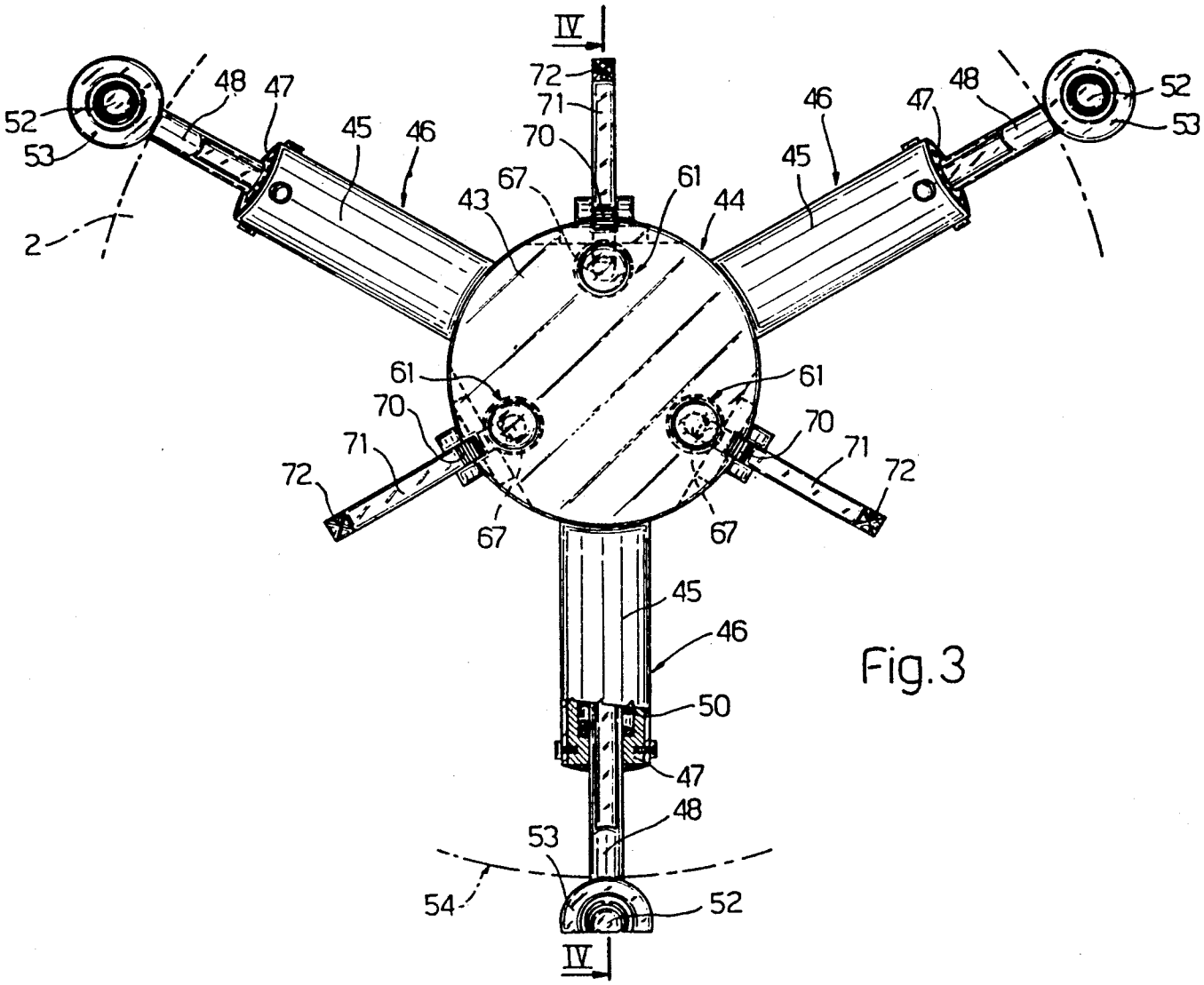
FIG. 3 is is the frontal elevation of a detail of the device illustrated in FIGS. 1 and 2.

The numeral 27 denotes a bracket rigidly associated with the intermediate part of the support 11 and carrying a further linear actuator 28, constituting the first actuator device 14, of which the rod 29 is attached by a hinge 30 to the end of a crank arm 31 keyed to the shaft 10. Reciprocation of this actuator causes the crank 31 to alternate between a first position (bold line, FIG. 1), in which the guide 9 intersects the second axis denoted 6, and a second position (phantom line, FIG. 1) in which the guide intersects the second axis denoted 7 (see also phantom line illustration of FIG. 2).

In the example of FIG. 1, the guide 9 comprises a plate 32 of essentially rectangular shape disposed at right angles to the first axis 4 and occupying a space between the shaft 10 and the magazine 5; the plate 32 is fastened rigidly by one face to the end of the shaft 10 directed toward the magazine 5, its longitudinal axis (not indicated) intersecting the first axis 4. The guide 9 further comprises two brackets 33 and 34 associated respectively with the two opposite ends of the plate 32 and projecting from the face opposite that fixed to the shaft 10, which are disposed on opposite sides of the first axis 4, set apart by a distance greater than that which separates the first axis 4 from each of the second axes 6 and 7, and serve to support two guide rods 35 running parallel to the plate 32 and normal to the first axis 4 in a direction denoted 36.

With continuing reference to FIG. 1, the slide 12 comprises a block 37 substantially of rectangular parallelepiped shape, affording a pair of through holes slidably engaged by the guide rods 35, and, projecting from the face directed toward the magazine 5, a tubular appendage denoted 38 which ensheaths a fixed shaft 39 forming part of the gripping device 13. The block 37 is set in motion by means of the third actuator device 17 and can be traversed in the direction denoted 36 between a first position (illustrated in FIG. 1), in which the tubular appendage 38 is coaxially aligned with the first axis 4, and at least one second position (phantom line, FIG. 2) in which the tubular appendage 38 is coaxially aligned with one or other of the second axes 6 and 7. Clearly enough, there will be one second position only as long as the two second axes 6 and 7 lie equidistant from the first axis 4, as is the case in the example illustrated, whereas there will be two distinct second positions in the event that the second axes 6 and 7 are set at dissimilar distances from the first axis 4, as might be the case in an alternative embodiment, which is not illustrated in the accompanying drawings.

The third actuator device 17 comprises a reversible electric motor 40 mounted to the bracket denoted 33 (FIG. 1), of which the output shaft drives a lead screw 41 accommodated rotatably by each bracket 33 and 34, though without freedom of axial movement, and engaging a nut 42 afforded by the block 37.

Figure 4:
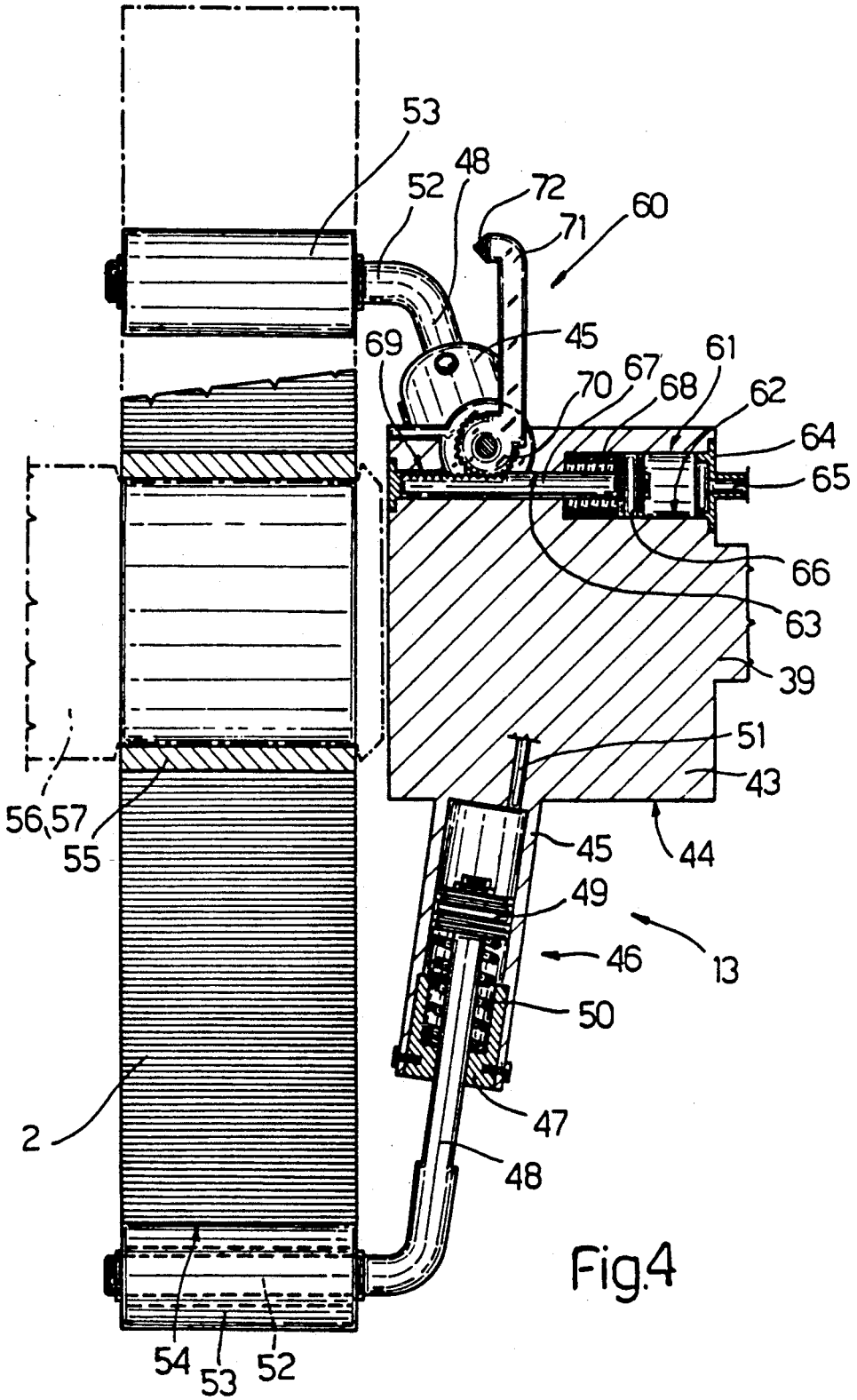
FIG. 4 is the section through IV—IV in FIG. 3.

The gripping device 13 (shown in FIG. 4) comprises a cylindrical head 43 rigidly associated with the projecting end of the fixed shaft 39, which can be traversed selectively and as one with the slide 12 between a first position of coaxial alignment with the first axis 4 and a second position coaxial with either one of the second axes 6 and 7. The head 43 exhibits a lateral surface 44 from which three tubular appendages 45 project in a substantially radial direction, spaced apart at equal distance around the axis of the head 43 and angled toward the magazine 5. Each such appendage 45 provides the outer casing of a relative actuator cylinder 46 and is capped at the projecting extremity by a cover 47 affording passage to a piston rod 48 accommodated slidably and to a fluid-tight fit, of which the piston 49, stroking internally of the appendage 45, is driven toward the cover 47 against the bias of a coil spring 50 by fluid supplied under pressure from a circuit denoted 51.

Each piston rod 48 has a profile substantially of 'L' shape, of which the bent end portion 52 is disposed parallel to the first axis 4 and carries a freely revolving roller 53. Thus, the three rollers are capable of movement in a transverse direction, tensioned by the relative coil springs 50, toward (FIG. 4) and away from (FIG. 5) an operating position of interaction with the cylindrical surface 54 of a full roll 2 of material, whereby the single roll 2 is supported and its tubular core 55 positioned in coaxial alignment with the head 43, either facing the magazine 5, or facing the pivot 56 or 57 of the selected uncoiling station 58 or 59 (FIG. 1), which occupies a position coaxial with the corresponding second axis 6 or 7.

Figure 5:
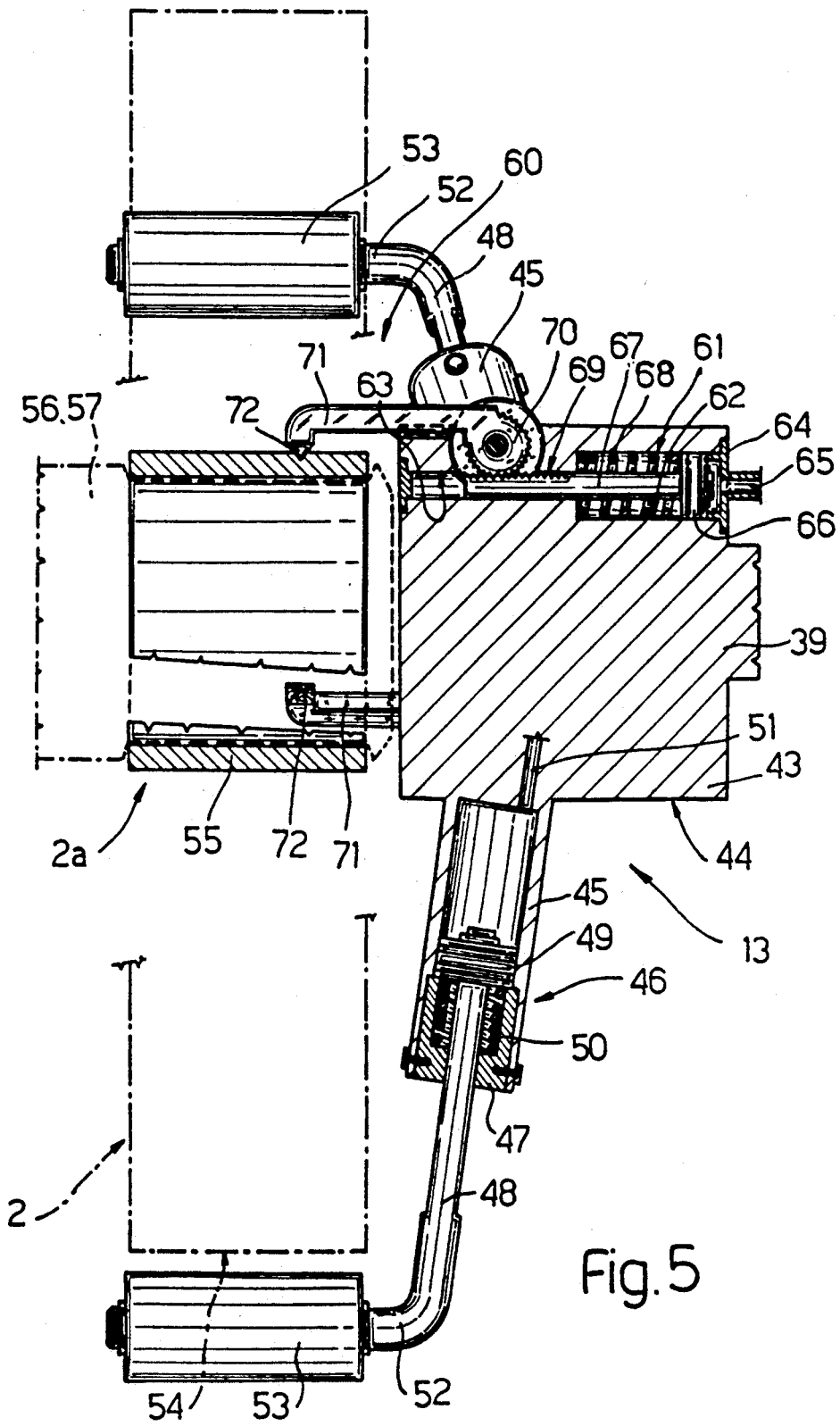
FIG. 5 is a section similar to that of FIG. 4, which shows the selfsame detail in a different operating position.

The gripping device 13 is equipped further with a device 60 serving to remove and eject the empty cores 55 of spent rolls 2a (FIG. 5). This comprises a plurality of pressurized fluid cylinders 61 incorporated directly into the head 43, disposed parallel with and distributed uniformly about the relative axis. Each such cylinder 61 comprises two bores 62 and 63 extending coaxially through the head 43 of which the first, larger in diameter, is capped at one end by a cover 64 admitting the final stretch of a circuit 65 through which pressurized fluid is supplied to the cylinder 61, and occupied slidably and to a fluid-tight fit by a piston 66.

The second bore 63 merges with the end of the first bore 62 farthest from the cover 64, and slidably accommodates a rod 67 rigidly associated with the piston 66. The larger bore 62 also accommodates a coil spring 68 which, in the absence of any input from the pressurized fluid circuit 65, causes the piston 66 to shift from an at-rest position (FIG. 4) to an operative position (FIG. 5).

The surface of each rod 67 affords a rack 69 in mesh with a respective sector gear 70 mounted in such a way as to rotate about an axis orthogonal to that of the head 43. Each sector gear 70 carries a substantially radial arm 71 that projects from the head in a substantially radial direction when the corresponding rod 67 is in the at-rest position (FIG. 4), and lies substantially parallel with the axis of the head 43 when the rod 67 assumes the operative position (FIG. 5). Finally, the unattached end of each arm 71 affords a transverse tooth 72 positioned to engage the outer surface of an empty core 55 when the arm 71 is moved into the operative position parallel with the axis of the head 43.

The operation of the device 1 will now be described, starting from a situation in which one of the two uncoiling pivots, for example that denoted 56, is occupied by a depleted roll 2a, with the transfer unit 8 occupying any given position relative to the magazine 5 and the uncoiling stations 58 and 59. This much stated, it should be appreciated that in any situation where the transfer unit 8 is inactive or in a 'ready' state, the gripping device 13 will always be positioned in coaxial alignment with the first axis 4, and the second actuator device 15 retracted so as to distance the device 13 from the take-up station 16.

With the roll 2a finally depleted, a signal will be generated in conventional manner from the uncoiling station 58, whereupon the first actuator device 14 is activated to rotate the guide 9 about the first axis 4 and cause its longitudinal axis to intersect the corresponding second axis 6, unless already in this same position. The third actuator device 17 is then activated to traverse the gripping device 13 along the guide 9 and thus bring the axis of the head 43 into alignment with the second axis 6. The second actuator device 15 now extends to move the transfer unit 8 into the position whereby the gripping device 13 is brought forward, in this case below the take-up station 16, with the rollers 53 encompassing the core 55 of the empty roll 2a and the arms 71 of the removal device 60 held in the at-rest position (FIG. 4) by pressure of the fluid supplied to the cylinders 61 from the relative circuits 65.

At this juncture, pressure to the cylinders 61 is shut off and the cylinders themselves are vented to to a return or unloading port (not illustrated) by means of a conventional two-way solenoid valve (not illustrated), allowing the rods 67 to retract under the force of the springs 68 and causing the arms 71 to assume the operative position of FIG. 5, so that the teeth 72 engage the external surface of the core 55 left by the depleted roll 2a; the core 55 can now be removed from the pivot 56 by retracting the second actuator device 15, and discarded by repressurizing the cylinders 61.

This done, the third actuator device 17 activates to traverse the gripping device 13 into alignment with the first axis 4.

With pressure still maintained in the cylinders 61 of the ejection device 60, fluid is also supplied under pressure to the cylinders 46 of the gripping device from the relative circuits 51 in such a way as to compress the coil springs 50 and spread the rollers 53, whereupon the second actuator device 15 is activated to move the gripping device 13 into the take-up station 16, thus causing the rollers 53 to encompass the outer surface 54 of the endmost roll 2 occupying the magazine 5, which will have been shunted forward previously into the take-up position by the fourth actuator device 18.

By depressurizing the relative cylinders 46 at this point, the rollers 53 of the gripping device 13 are made to engage the outer surface 54 of the roll 2, which is thus firmly held and can be removed from the magazine 5 by retracting the second actuator device 15. The relevant actuator devices 17 and 15 now operate in sequence to transfer the roll 2 from its position of alignment with the first axis 4 to a position of alignment with the selected second axis 6 and thereupon to slip the roll 2 onto the relative pivot 56. The roll 2 will then be released by pressurizing the cylinders 46 and retracting the second actuator device 15, whereupon the third actuator device 17 operates to return the gripping device 13 to its position of coaxial alignment with the first axis 4.

The entire sequence of operations thus described will take place within the time taken for a roll 2 to uncoil from the remaining pivot 57. When this roll is depleted, the guide 9 is rotated by the first actuator device 14 from the position occupied hitherto, intersecting the axis denoted 6, to the position of intersection with the remaining axis 7, whereupon the cycle is repeated.

Alternatively, rotation of the guide 9 might be effected having first picked up a new roll 2 from the magazine 5 and retracted the transfer unit 8, though whichever the case, the guide 9 will always be positioned at the selected axis 6 or 7 before distancing the gripping device 13 and the roll 2 from the first axis 4.

It will be observed that a device 1 structured in the manner described above allows the rolls 2 to be transferred from the magazine 5 to either one of the two uncoiling pivots 56 or 57 of the machine 3 without ever rotating about the first axis 4. That is to say, the passage of the single roll 2 from the magazine 5 to the pivot 56 or 57 occurs always along a rectilinear trajectory established by the guide 9, which can be positioned in readiness by rotation about the first axis 4 while the gripping device 13 remains coaxially aligned with this same axis 4.

With this method of transfer, not only are moments of inertia attributable to the rolls 2 reduced practically to zero during the transfer movement, thereby reducing the levels of driving and braking torque which need to be transmitted to the guide 9 from the first actuator device 14, but in addition, the gripping device 13 is able to move accurately to any given point within a circle centered on the first axis 4 and of radius substantially equivalent to the length of the guide 9, thereby enabling a successful integration of the device 1 into an existing machine 3 of any given design.

What is claimed is:

1. A method of changing rolls of strip material on a machine having a roll supply-holding station in which a plurality of individual rolls of strip material which are subsequently to be used by the machine are serially disposed in coaxial alignment along a first axis and having at least two roll-uncoiling stations at which respective individual rolls are uncoiled of strip material about respective second axes, said method comprising:

successively transferring said rolls individually from said roll supply-holding station to respective ones of said roll-uncoiling stations along respective rectilinear trajectories, using a guide, including rotating said guide about said first axis to provide each respective rectilinear trajectory.

2. The method of claim 1, wherein transferring each roll from said roll supply-holding station to a respective roll-uncoiling station includes:

(a) gripping that roll at said roll supply-holding station using a gripper, and moving that roll away from said roll supply-holding station along said first axis and into juxtaposition of the gripper with said guide;

(b) rotating said guide about said first axis until a guide path which is defined along said guide coincides with a straight line connecting said first axis with a respective one of said second axes; and (c) traversing said gripper along said guide path of said guide and thereby moving the respective said roll into a respective said roll-uncoiling station.

3. The method of claim 2, wherein:

step (b) is conducted prior to step (a).

4. The method of claim 2, wherein:

in conducting step (a), the respective roll is gripped by moving a plurality of gripping elements of said gripper radially inwardly relative to the longitudinal axis of the respective roll from locations uniformly distributed around said longitudinal axis, and thereby causing said gripping elements to grip an outer peripheral surface of the respective roll.

5. The method of claim 2, wherein said machine further includes a roll central core ejector associated with said gripper, said method further including:

prior to conducting step (c), operating said ejector to remove a central core of a depleted roll from the respective said roll-uncoiling station to which a roll is to be next transferred in step (c).

6. A device for changing rolls of strip material on a machine having a roll supply-holding station in which a plurality of individual rolls of strip material which are subsequently to be used by the machine are serially disposed in coaxial alignment along a first axis and having at least two roll-uncoiling stations at which respective individual rolls are uncoiled of strip material about respective second axes, by successively transferring said rolls individually from said roll supply-holding station to respective ones of said roll-uncoiling stations along respective rectilinear trajectories, said device comprising:

a guide mounted for rotation about said first axis, said guide having a slide associated therewith for sliding along a guide path provided along said guide;

a gripper for successively gripping each roll at said roll supply-holding station and moving the respective roll away from said roll supply-holding station along said first axis and into juxtaposition of the gripper with said guide at said slide;

a first actuator for positioning said guide by rotation of said guide about said first axis until said guide path coincides with a straight line connecting said first axis with a respective one of said second axes; and a second actuator for traversing said slide and said gripper therewith along said guide path of said guide and thereby moving the respective said roll into a respective said roll-uncoiling station.

7. The device of claim 6, wherein said gripper comprises:

a head rigidly associated with said slide;

a plurality of gripping elements carried by said head and uniformly distributed about said head; and a third actuator for moving said gripping elements of said gripper radially inwardly relative to the longitudinal axis of the respective roll from locations uniformly distributed around said longitudinal axis, and thereby causing said gripping elements to grip an outer peripheral surface of the respective roll.

8. The device of claim 7, further comprising:

a roll central core ejector associated with said gripper; and means for operating said ejector to remove a central core of a depleted roll from the respective said roll-uncoiling station to which a roll is to be next transferred.

9. The device of claim 8, wherein said ejector comprises:

a plurality of arms projecting from said head; and said means for operating said ejector includes a fourth actuator, interposed between said head and said arms for moving said arms towards and away from a position of interaction with an external surface of a respective said central core.

10. The device of claim 7, wherein:

said gripper elements comprise rollers for rollingly gripping the outer peripheral surface of the respective roll; and said third actuator is provided by an extensible-retractable piston and cylinder arrangement having an L-shaped arm effectively connecting with said gripper.

* * * * *